United States Patent [19]

Zimmern

[11] Patent Number: 4,509,341

[45] Date of Patent: Apr. 9, 1985

[54] ECONOMIZER DEVICE FOR A REFRIGERATING MACHINE, A HEAT-PUMP OR THE LIKE

[76] Inventor: Bernard Zimmern, 6 New St., East Norwalk, Conn. 06855

[21] Appl. No.: 619,186

[22] Filed: Jun. 11, 1984

Related U.S. Application Data

[63] Continuation-in-part of Ser. No. 491,475, May 4, 1983, abandoned.

[30] Foreign Application Priority Data

May 13, 1982 [FR] France ..... 82 08325

[51] Int. Cl.[3] ..... F25B 43/00

[52] U.S. Cl. ..... 62/512; 62/500; 62/509

[58] Field of Search ..... 62/500, 509, 512

[56] References Cited

U.S. PATENT DOCUMENTS

| | | | |
|---|---|---|---|
| 2,519,010 | 8/1950 | Zearfoss, Jr. | 62/500 |
| 3,077,087 | 2/1963 | Japhet | 62/512 |
| 3,163,998 | 11/1965 | Wile et al. | 62/512 |
| 3,563,054 | 2/1971 | Lofereen et al. | 62/512 |
| 3,686,831 | 8/1972 | Libby | 55/199 |

FOREIGN PATENT DOCUMENTS

| | | |
|---|---|---|
| 1331998 | 5/1962 | France . |
| 1571880 | 6/1969 | France . |
| 2321613 | 4/1976 | France . |

*Primary Examiner*—Ronald C. Capossela

*Attorney, Agent, or Firm*—Ziems, Walter & Shannon

[57] ABSTRACT

A refrigerating machine including a compressor, a condenser, an expansion valve, an evaporator and an economizer device in the form of a centrifugal liquid gas separator, the gas space of which is connected to an intermediate pressure point of the compressor. The liquid space of the separator is connected to the evaporator via a valve controlled to maintain an annulus of liquid in the separator. The inlet of the separator is connected to the outlet of the expansion valve. The separator is driven by the compressor shaft.

23 Claims, 10 Drawing Figures

ECONOMIZER DEVICE FOR A REFRIGERATING MACHINE, A HEAT-PUMP OR THE LIKE

This is a continuation-in-part of Ser. No. 06/491,475, filed May 4, 1983 abandoned.

BACKGROUND OF THE INVENTION

The invention relates to an economizer device for a refrigerating machine, a heat-pump or the like. The invention also relates to a machine equipped with such a device.

It is known to provide economizer devices in refrigerating systems or the like using rotating positive displacement or centrifugal multistage compressors. In such a system, as shown in FIG. 1, or in an alternative embodiment in FIG. 2, a compressor 1 takes in a refrigerant gas arriving through a conduit 2 and discharges it into a condenser 3 and a storage tank 4 in liquid form. In some units, as a practical matter, this tank is formed by a part of the condenser, but the tank will be maintained hereinbelow for a clear understanding of the description. From this tank the condensed liquid flows via a conduit 5 to a vaporization tank 6, the upper part of which is connected by a conduit 7 to at least one port 8 in the casing of the compressor 1 at a point where the pressure is intermediate between the intake pressure and the discharge pressure. Liquid is separated from the gas in this intermediate tank 6 and flows via a conduit 9 to an evaporator 10 after having travelled through an expansion valve 11. The gas vaporized in the valve 11 or the evaporator 10 returns to the compressor 1 via the conduit 2.

A valve 12 is mounted between the tanks 4 and 6 and is controlled by a float 13 measuring the level in the tank 6. In the same way, the valve 11 is controlled by a device 14 which measures the superheat at the evaporator exit. When more refrigeration is required from the evaporator 10, the device 14 opens the valve 11 wider, and the liquid level in the tank 6 decreases, whereby the opening of the valve 12 increases.

The known advantage of this economizer device is that a part of the gas formed to cool down the liquid going to the evaporator is recompressed from an intermediate pressure and not from the intake pressure. This improves the efficiency and increases the refrigerating capacity of the compressor. Nevertheless, this device has various drawbacks. First of all, it is bulky and expensive since it requires an extra tank 6 and an extra load of liquid refrigerant to fill up the tank. Moreover, the devices using floats are often subject to failures. Finally, this economizer device renders the system difficult to control because the expansion valve 11 does not work under the pressure existing between the condenser and the evaporator, but under the reduced difference between the intermediate pressure and the intake pressure, and because the system cannot work when the economizer is not itself in operation, for instance at part load of the compressor when said compressor is a screw compressor provided with slides. Instead, in this case, the pressure at the orifice 8 becomes equal to the intake pressure, and there is no longer a difference of pressure between the tank 6 and the evaporator 10 to permit the circulation of the liquid. Therefore, additional devices such as a check valve on the conduit 7 must be provided. However, such additional devices may then generate liquid bursts via the conduit 7 into the compressor upon reopening of said check valve, and the liquid which, when the valve was shut, was necessarily at the condenser pressure, suddenly tends to return to the intermediate pressure. Such bursts may to a certain extent cause serious damage to the compressor.

Thus, it is more usual to utilize the device represented in FIG. 2, wherein the conduit 9 and the expansion valve 11 are directly connected to the tank 4, but the device is provided with an exchanger 15 cooled by an auxiliary evaporator 16 placed on an economizer line 8 and fed by an expansion valve 17 controlled by superheat measuring means 18. In this embodiment, most of the drawbacks of the device of FIG. 1 are overcome since, whether the economizer is operating or not, the expansion valve 11 always works under the difference of pressure existing between the evaporator and the condenser. Nevertheless, this embodiment has other disadvantages. This device remains expensive because it requires an evaporator-exchanger and an additional expansion valve 17. On the other hand, the operation of the exchanger requires a temperature difference between the exchanger 15 and the auxiliary evaporator 16, said difference usually being of the order of 5° C., the consequence being that the liquid reaching the valve 11 is much less supercooled than in the device shown in FIG. 1, and this substantially reduces the performance of the economizer and even eliminates any economizer performance at lower compression ratios.

SUMMARY OF THE INVENTION

The object of the invention is to provide a cheap and efficient economizer device. According to the invention, there is provided an economizer device for a refrigerating, heat-pump or like system comprising a compressor and a circuit connected to the exhaust of the compressor, said circuit including at least a condenser, an expansion device, an evaporator connected to the intake of the compressor, and an economizer device mounted between the expansion device and the evaporator, and having a separator for separating liquid and gas generated by the expansion device, a gas conduit connecting the separator to at least one port provided through the casing of the compressor at a point where the pressure is intermediate the intake pressure and the discharge pressure, and at least one liquid conduit connecting the separator to the evaporator, wherein the separator includes a rotor mounted within a housing, the gas conduit opens into a central region of the housing, the liquid conduit opens into a peripheral annular region of the housing, and the economizer device moreover has a valve mounted on the liquid conduit and apparatus for controlling the valve mounted on the liquid conduit in such a way as to maintain a circumferentially driven liquid annulus which in operation builds up in the peripheral annular region of the separator. In a preferred embodiment of the invention, the rotor is mounted on the shaft of the compressor.

The device overcomes the drawbacks of the known economizer devices. For example, the device is very compact, there is no additional liquid tank required and the cost of a rotor mounted at the extremity of the compressor shaft is very low compared to the separator tanks or exchangers described hereabove. The liquid delivered by the device is subcooled to its maximum, i.e., down to the temperature corresponding to the pressure of saturated vapor of the separated gas. Simultaneously, because of the centrifugal effect developed by the circumferentially traveling liquid annulus, the pressure at the outlet of the separator is higher than this pressure, which makes its flowing to the evaporator easier. The expansion valve always works under a substantial difference of pressure, since it is not placed between the economizer and the evaporator, but between the condenser and the economizer. In addition, this device requires only very little energy, since the viscous friction of the liquid annulus which forms at the periphery of the rotor is negligible, due to the extremely low viscosity of the liquid refrigerants. The rotor could even be used to recover, in a known way, a part of the expansion energy by coupling it with an expansion turbine.

It has also appeared that the above-mentioned results can be reached when the shaft of the compressor is driven by a two pole motor either at 3000 rpm or at 3600 rpm, depending on whether the frequency of the network is 50 or 60 Hertz, and the size of the rotor ensures at such speeds an acceptable gas-liquid separation is small enough to permit locating it between the actuators of slides controlling the capacity of the screw-and-pinion compressors, such slides being described, for example, in French Pat. No. 2,321,613.

BRIEF DESCRIPTION OF THE DRAWING

The invention will be more readily understood from the description hereafter and the accompanying drawing, given by way of non-limitative examples and in which.

DETAILED DESCRIPTION OF THE PREFERRED EMBODIMENT

Figure 1:
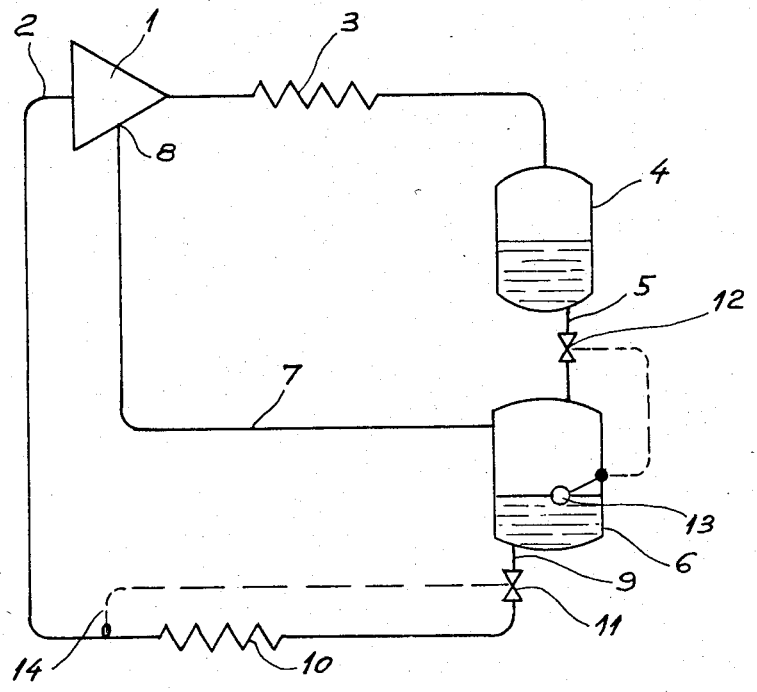
FIGS. 1 and 2, as indicated, are schematic illustrations of representative prior art.
Figure 2:
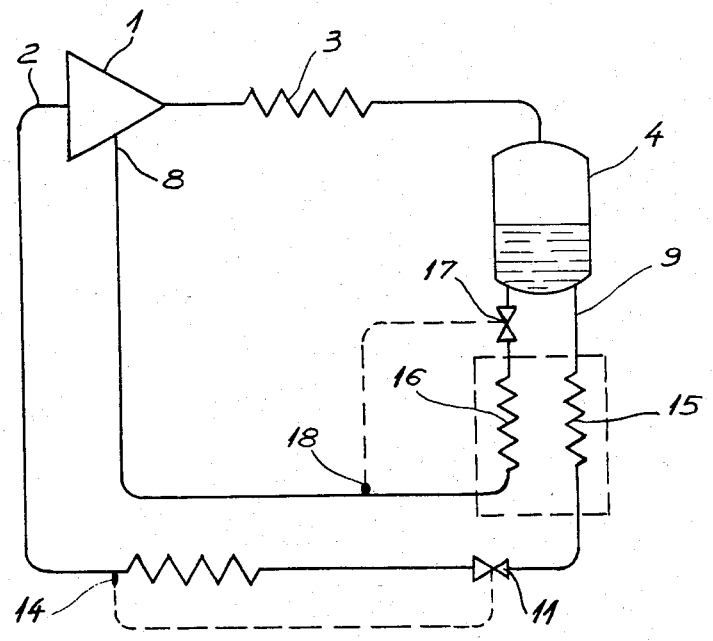
Figure 3:
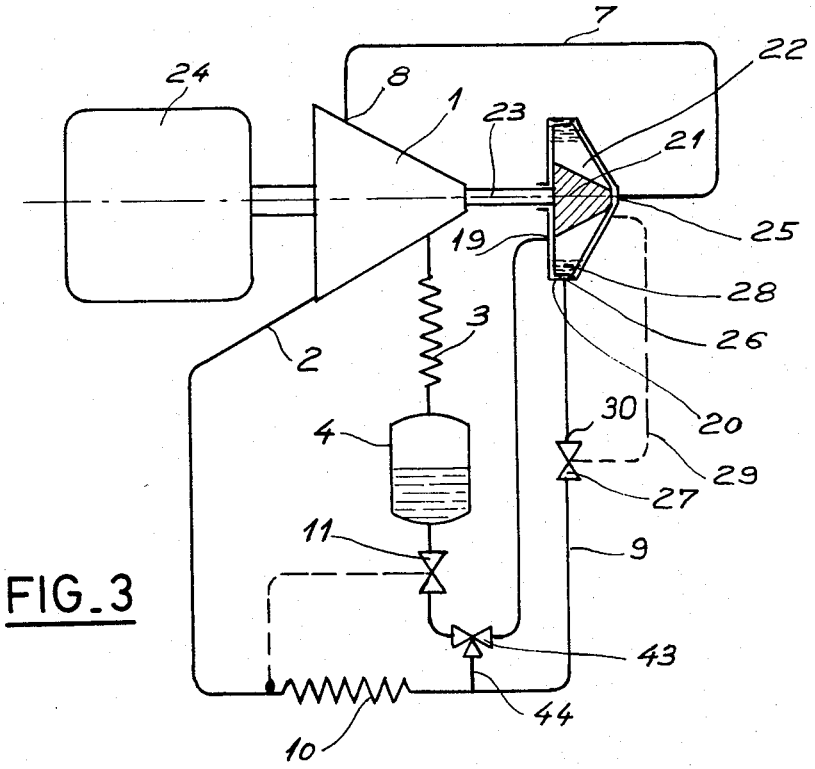
FIG. 3 is a schematic diagram of a refrigerating system in accordance with the invention.

In the system shown in FIG. 3, elements corresponding to those of FIGS. 1–2 are given the same numeral references, especially the compressor 1, the outlet of which is connected to the condenser 3 followed by the tank 4. The intake 2 of compressor 1 is connected to the outlet of the evaporator 10. The liquid refrigerant issued from the tank 4 travels through the expansion valve 11 where the liquid is partially vaporized. The liquid-gas mixture thus obtained reaches, via an orifice 19, a stationary housing 20 in which a rotor 21, having blades 22 in this embodiment, is rotatably mounted and driven by a shaft 23 coupled to an auxiliary motor, or to the shaft of the compressor 1 itself driven by a motor 24.

Upon rotation of the rotor 21, liquid entering through port 19 is projected to the inner periphery of the housing 20 whereas gas remains in a gas-region surrounding the axis of the rotor and leaves the housing 20 via an orifice 25 connected to the conduit 7. The orifice 25 opens into the gas-region of the housing 20, and more precisely at the center of one end wall of housing 20. A wall of the housing 20 has an orifice 26 connected to the conduit 9 via a conduit 30 and a control device 27 adapted to maintain around the rotor 21 a liquid annulus 28 preferably with an approximately constant radial thickness. The liquid annulus is thus maintained independently of system pressure in housing 20. The pressure can indeed vary to a large extent, for example in a ratio of 1:3, due to the operating conditions in the compressor 3. Especially in the case of a screw compressor, the delivery rate of which is set by adjusting the delay in insulating the threads from the intake port, the pressure at port 8, which is transmitted to housing 20 through conduit 7, may be more or less different from the intake pressure according to the setting of the delivery rate. One of the ways for maintaining thickness of the annulus 28 relatively constant includes measuring the pressure generated by centrifugal force, comparing the pressures of the gas and of the liquid leaving the housing 20, and opening, more or less, a valve mounted inside the device 27 to allow the evacuation of the liquid towards the evaporator.

Figure 4:
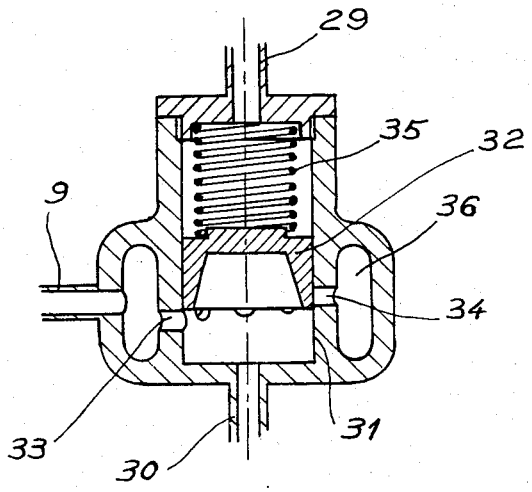
FIG. 4 is an axial sectional view of a valve allowing a liquid annulus to be maintained around the rotor of the device.

An exemplary embodiment of the device 27 is shown in FIG. 4. The liquid coming from the orifice 26 via the conduit 30 reaches one end of a bore 31 in which a piston 32 is axially movable and, according to its axial position, covers or uncovers radial apertures such as 33 or 34 provided in the wall of the bore 31. The apertures are located around the cylinder so as to form approximately a helix so that the piston 32 travelling away from conduit 30 uncovers sequentially the apertures in the chamber defined in bore 31 by piston 32 which communicate with conduit 30. A conduit 29 communicating with the gas-region of housing 20 opens in that end of bore 31 which is opposite to conduit 30. Thus, the pressure imposed by the conduit 29 on that side of piston 32 is the pressure of the gas at the center of the centrifugal separation device. In addition, a compression spring 35 is provided between piston 32 and that end of bore 31 in which conduit 29 opens. Spring 35 urges the piston 32 toward conduit 30 and therefore tends to close the apertures such as 33 and 34.

The operation of the control device 27 is as follows. Upon the lower face of the piston the pressure of the liquid coming from port 26 prevails, whereas on the other side the pressure of the gas and the biasing force of the spring prevails. Thus, the piston settles to a position in which the spring balances the difference of pressure between gas and liquid, i.e. the pressure difference created by the centrifugal force, which is nearly proportional, at a given rotational speed of the rotor 21, to the radial thickness of the liquid annulus or ring 28. If this thickness increases, the difference of pressure increases, pushing the piston 32 upward until, new apertures having opened, the flow through device 27 balances the liquid flow coming from port 19 and the initial thickness of the liquid ring is restored.

It is desirable that the biasing force of the spring varies little with respect to the travel of the spring. This is obtained for instance with a long enough spring. The volume facing the apertures is very wide so that the pressure in the volume is not influenced by the flow through the apertures. Furthermore, the apertures are perpendicular to the travel of the piston so that the direction of the flow with respect to the apertures does not generate a dynamic pressure load on the front wall of piston 32. The liquid, after discharging through the apertures, such as the aperture 33, suddenly drops in pressure and thus partly flashes off, whereupon the liquid-gas mixture is gathered in a manifold chamber 36 and leaves via conduit 9 to the evaporator.

Figure 5:
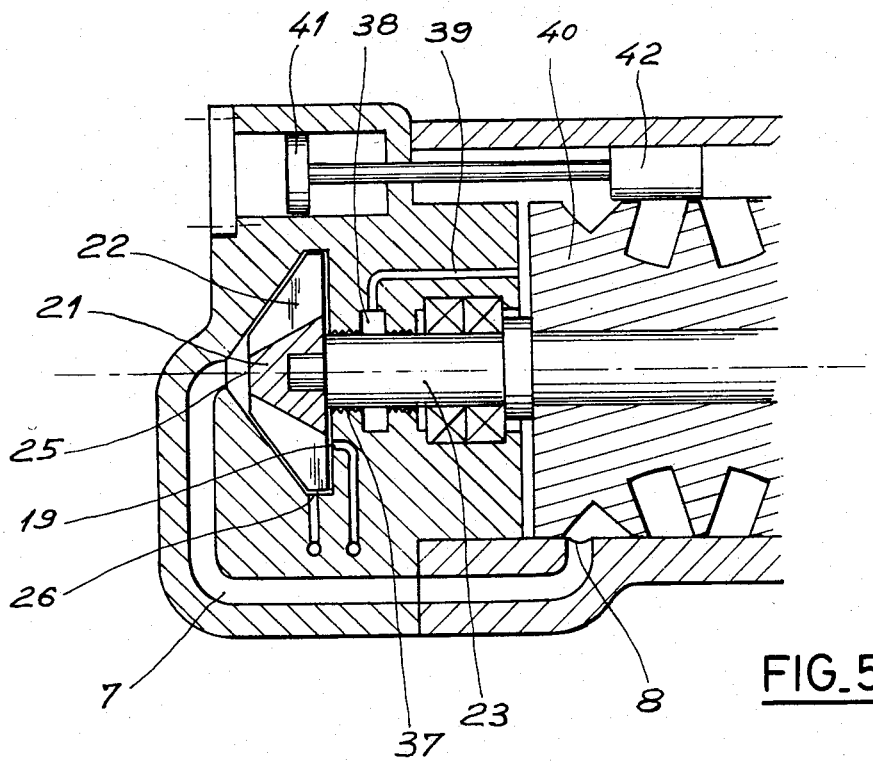
FIG. 5 is a partial sectional view of a screw-and-pinion compressor provided with an economizer device in accordance with the invention.

An axial part-sectional view of a compressor with cylindrical screw and control slides in accordance with French Pat. Nos. 1,331,998 and 2,321,613 is shown in FIG. 5, in which a practical embodiment of the separation device of FIG. 3 on the shaft of a compressor may be seen. The shaft 23 cooperates with labyrinths, such as 37, and a recuperating chamber 38 which returns the gas leaks originating between the shaft and the labyrinth to the bottom of the screw 40 and from there, as is known and not shown, to the intake. It will be noted that the centrifugal rotor is sufficiently small to find its place between the actuators 41 of the control slides 42.

As a numerical example, a compressor with screw and pinion-wheel, with a screw of a 140 mm diameter, sweeping a volume of approximately 2500 liters/minute, at 3000 rpm, has been equipped with a centrifugal rotor of which the internal diameter of the blades was only 110 mm. By sending all the condensed liquid (coming from the gas taken in under 4 bars, the gas being refrigerant R 22), i.e., approximately 40 liters/minute via the port 19, it has been measured that the liquid exiting through the port 26 was at the temperature of saturated vapor of the gas exiting through the port 25, with an accuracy of less than a tenth of a degree C. and did not contain visible bubbles. Therefore the liquid was perfectly separated, and the gas exiting through the port 25 contained less than 3 percent by mass of liquid. The overpressure created by the liquid ring was approximately 0.35 bars.

Referring now again to FIG. 3, a three way valve is located after the expansion valve 11 on the circuit going to the centrifugal device. The third way of the three-way valve 43 is connected by a by-pass 44, the other end of which is connected to conduit 9 between valve 27 and evaporator 10. Normally when the centrifugal separation device is operating, the way of the three-way valve 43 towards housing 20 is open and the way towards by-pass 44 is closed. If the operation of the economizer is to be stopped, the path to by-pass 44 is opened and the path toward housing 20 is closed. Due to its construction, the valve 27 closes and acts as a check valve. It is therefore possible to leave the economizer port 8 open, even if, resulting from the capacity control, this port is at the intake pressure and if this pressure prevails in the whole centrifugal device 20, 21, 22.

Figure 6:
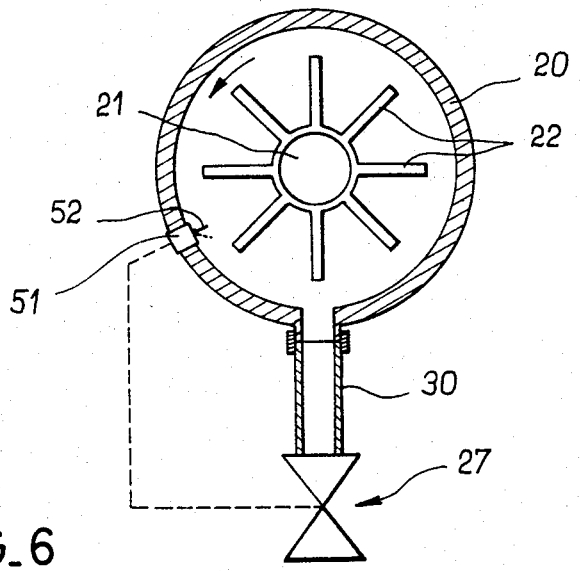
FIG. 6 is a sectional view taken along a plane perpendicular to the axis of the rotor and showing an alternative embodiment of the economizer.

In the embodiment of FIG. 6, the blades 22 of rotor 21 do not extend as far as the side wall of housing 20. In the side-wall, there is mounted a switch 51 the actuating lever of which is a blade 52 which projects inside housing 20 but is short enough not to come into contact with blades 22 of rotor 21. In the absence of circumferential movement of the liquid annulus 28 to apply a force on the blade 52, the latter recovers automatically a rest position.

The control device 27' in FIG. 6 is formed in part by an electrovalve, the operation of which is controlled in an on-or-off manner by switch 51. When the blade 52 is in the rest position, the electrovalve 27' is controlled to be closed. The liquid ring which builds up in housing 20, when having a small thickness, is weakly driven by the blades 22 of rotor 21 and rotates slowly because the major part of the liquid ring is out of reach of the rotor 21. The blade 52 is not subjected to a sufficient hydrodynamic pressure to be pivoted into the active position, and the electrovalve remains closed. This results in an increase of the quantities of liquid in housing 20 and, therefore, of the radial thickness of the liquid ring until the liquid is driven by the rotor 21 at a substantial speed, almost equal to that of blades 22. The blade 52 becomes subjected to a much higher hydrodynamic pressure and is moved to its active position shown in dotted lines in FIG. 6. This results in the opening of electrovalve 27' until the thickness of the liquid ring decreases and the blade 52 recovers its rest position.

Figure 7:
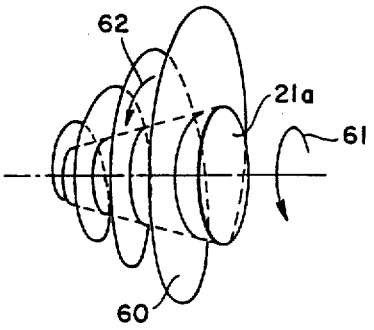
FIG. 7 is a perspective view of an alternate embodiment of the rotor for use in the economizer device according to the present invention.
Figure 8:
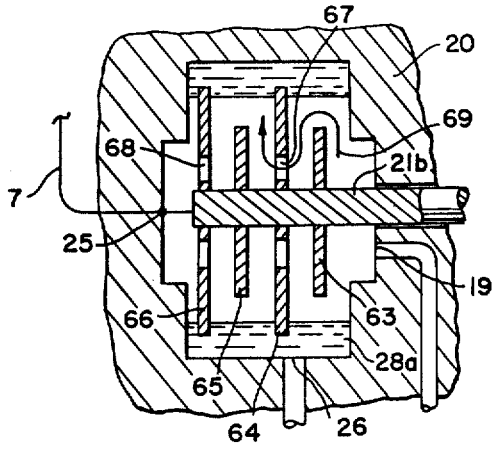
FIG. 8 is a cross sectional view of another embodiment of the rotor.

FIGS. 7 and 8 show alternative embodiments of the rotor 21, in which the portion of the rotor by which the gas-liquid separation is accomplished by centrifugal force is no longer made of channels parallel to the axis of rotation, as in the case of a bladed rotor, but is made of channels which are not parallel to the axis of rotation. Indeed, it has been found that, in the case of a rotor as shown in FIGS. 3, 5 or 6, the gas flowing axially has nothing to impinge on and that a better separation of liquid can be achieved by combining the rotation effect together with a change of direction. FIG. 7 shows, for instance, a perspective view of a rotor **21*a* for replacing rotor 21 in housing 20 of FIG. 5. The rotor 21*a* is provided not with blades but with a fin 60 which envelops the rotor in a screw-like manner. When such a centrifugal device rotates according to the direction of arrow 61, the gas-liquid mixture can no longer travel axially but must follow a nearly circular path around the rotor 21*a*, the path shown by arrow 62**, and thereby impinge on the fin and be forced to travel a much longer way than if it was following a path parallel to the rotor axis. The outer skirt of the fin, while centrifugally acting on the liquid which impinges on it and putting in rotation the annulus of liquid, also helps to pull back the liquid toward the annulus and prevents such liquid from escaping toward the economizer by the action of the screw in the liquid.

FIG. 8 is a sectional view of a second embodiment of a rotor having separation channels which are not parallel to the axis of rotation. One sees that on a rotor **21*b* there is assembled a series of discs such as 63, 64, 65 and 66, discs 63 and 65 being smaller in diameter than discs 64 and 66 and defining a gas passageway between the small discs 63, 65 and the annulus 28*a*. The larger diameter discs 64 and 66 dip into the liquid annulus and then drive the annulus circumferentially. The large diameter discs 64 and 66 also carry openings like 67 and 68. As a result, the mixture of gas and liquid arriving by opening 19 is not only forced to rotate by friction with the disc but must follow a path of which part is shown by arrow 69**, and must, therefore, impinge on the discs.

Figure 9:
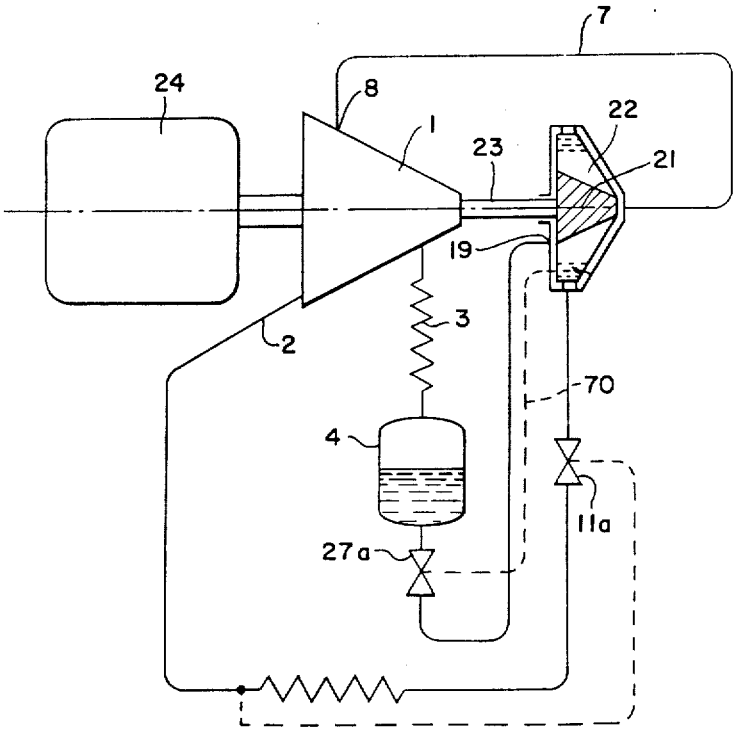
FIG. 9 is a schematic diagram of an alternate arrangement of a refrigeration system in accordance with the invention.

FIG. 9 shows an improved arrangement of the refrigeration circuit in which the position of the expansion valve 11 and control valve 27 of FIG. 3 are exchanged. It has been found that, in the arrangement shown in FIG. 3, when the expansion valve is closed because there is temporarily no call for liquid in the evaporator 10, the annulus 28 disappears quickly for various reasons. The valve 27, though closed, is generally not hermetically sealed; the rotation absorbs a little power which, though small, vaporizes the annulus; and the cavity resonates with the economizer hole and heats. As a result, noise develops, created by the economizer hole resonating in the tube, and as well, heating of the tube and cavity occurs.

This problem of noise and heat development can be avoided by simply exchanging the relative positions of the expansion valve and control valve, as shown in FIG. 9. It can be seen that the control valve 27*a* is actuated by control line 70, which itself is triggered by a control device or system such as shown in FIG. 6, and sends liquid into the separating system as soon as the liquid annulus diminishes and even though there is no liquid leaving by the expansion valve 11*a*. Thus, even if the expansion valve 11*a* is closed, a continuous flow of gas evolving from vaporization of the liquid annulus which is continuously renewed, leaves by tube 7 toward the compressor. Moreover, the valve 27*a* can be made to assure a constant leak such as by use of bleed ports (not shown) or by less than complete seating in the "closed" condition thereof. The effect of the leak is that when expansion valve 11*a* closes, the liquid ring increases until liquid flows toward tube 7. It has been found that a small amount of liquid returning through the economizer line is enough to eliminate the noise created by a resonating economizer line.

Figure 10:
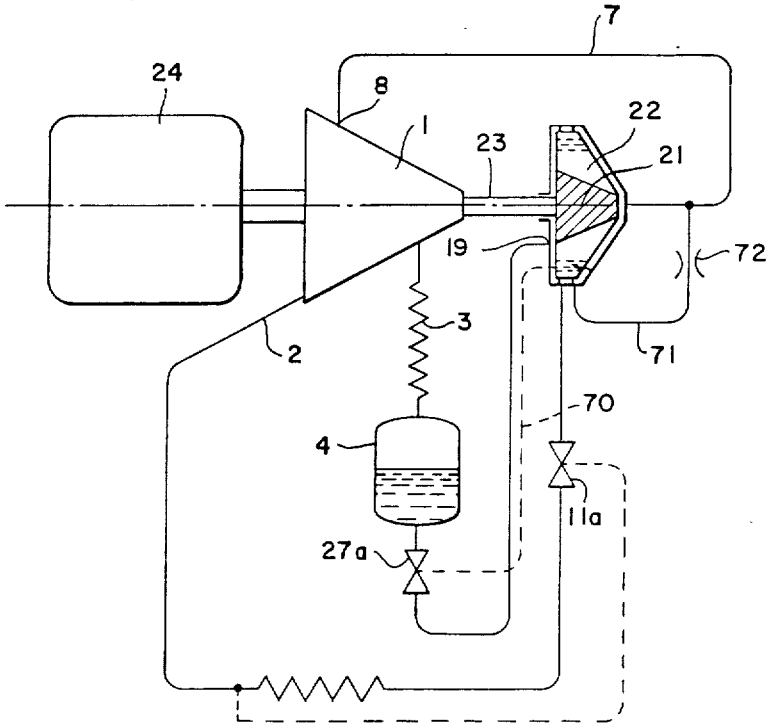
FIG. 10 is a schematic diagram of a variation in the embodiment of FIG. 9.

An alternative to the constant leak in the valve 27*a* is shown in FIG. 10. In this alternative, the liquid annulus is connected to the tube 7 by means of a tube 71 with a nozzle 72. The pressure around the annulus generates a spray of liquid through the nozzle 72 into the tube 7 and such spray stops the noise.

It should be noted that one side advantage of this arrangement is that, in case of opening of the expansion valve, the evaporator is immediately fed with liquid, whereas in the case of FIG. 3, there is some time lag due to the time needed to rebuild the liquid annulus if the system has run long enough without fresh inflow to make the annulus disappear.

It should also be noted that without changing the invention it would be possible to actuate the controlling valve 27 by a system similar to the one illustrated in FIG. 4, and to short circuit the centrifugal separator and connect the tank 4 directly to the expansion valve 11*a* in case the economizer hole 8 is brought back to intake pressure (at part load conditions for instance).

Having disclosed several embodiments of the invention, it will be apparent to those skilled in the art and it is contemplated that modifications and/or changes in the illustrated and described embodiments may be made without departure from the invention. This is especially true with respect to the specific means used to maintain the liquid ring 28, 28*a*. Accordingly, it is expressly intended that the spirit and scope of the present invention be determined by reference to the appended claims.

I claim:

1. A refrigerator, heat-pump or like apparatus comprising a compressor provided with a casing having at least one intake port, at least one exhaust port, and at least one economizer port at a point where the pressure in the casing is, in operation, intermediate intake pressure and exhaust pressure; and a fluid circuit between the exhaust and the intake of the compressor, said circuit including a condenser, an evaporator, two valves between said condenser and said evaporator, a housing between said two valves, said housing having a central region and a peripheral region, a rotor mounted for rotation in said housing, a first gas conduit connecting said economizer port with said central region of said housing, substantially adjacent to the axis of rotation of said rotor, one of said two valves being an expansion valve and the second of said two valves having control means to maintain a liquid annulus which builds up in the peripheral region of the housing during operation of the apparatus with rotation of said rotor, and means for rotatably driving the rotor.

2. Apparatus according to claim 1 including a liquid conduit to connect said peripheral region of said housing to said control means, a second gas conduit connecting said central region of said housing to said control means, and wherein said control means is responsive to the difference between the pressure in said liquid conduit and said second gas conduit.

3. Apparatus according to claim 2, wherein said second of said two valves comprises a side wall defining a bore, aperture means in said side wall, said aperture means having an axial extent and communicating with an outlet, a first chamber in said bore, said first chamber communicating with said liquid conduit, a second chamber in said bore, said second chamber communicating with said second gas conduit, a piston separating said first chamber from said second chamber, said piston being movable so as to control communication of said aperture means with said first chamber, a spring biasing said piston towards said first chamber.

4. Apparatus according to claim 3, wherein the aperture means comprises radial apertures arranged substantially helicoidally with respect to the bore.

5. Apparatus according to claim 4, wherein said control means includes a manifold chamber connected to said outlet, and said aperture means opens into said manifold chamber.

6. Apparatus according to claim 3, wherein said control means includes a manifold chamber connected to said outlet, and wherein said aperture means opens into said manifold chamber.

7. Apparatus according to claim 1, wherein said control means is responsive to the hydrodynamic force of the liquid ring driven about said peripheral zone of said housing.

8. Apparatus according to claim 7, wherein said second of said two valves is an electrovalve and said control means includes a switch having a control member responsive to the hydrodynamic force of the liquid ring, said control member comprising a blade projecting within said housing.

9. Apparatus according to claim 1, wherein said compressor includes a shaft, and said means for rotatably driving said rotor is a mechanical connection to said shaft of the compressor.

10. Apparatus according to claim 1, wherein said rotor includes radial blades.

11. Apparatus according to claim 1, wherein said rotor defines channels which are not parallel to the axis of rotor rotation.

12. Apparatus according to claim 11, wherein said rotor includes a helical fin.

13. Apparatus according to claim 11, wherein said rotor includes a series of discs forming an angle with the axis of rotation of said rotor.

14. Apparatus according to claim 13, wherein said series includes a plurality of discs having a first diameter and alternate discs having a second diameter different from said first diameter.

15. Apparatus according to claim 14, wherein said first diameter is greater than said second diameter, and said plurality of discs define openings.

16. Apparatus according to claim 1, including means to define a first fluid passage connecting said condenser to said housing and a second fluid passage connecting said housing to said evaporator, said expansion valve being positioned in said first fluid passage, and said second of said two valves being positioned in said second fluid passage.

17. Apparatus according to claim 16, wherein a bypass is provided between the inlet of the evaporator and said first fluid passage, and a three-way valve is mounted in said first fluid passage between said expansion valve and said housing and is connected to said bypass.

18. Apparatus according to claim 1, including means defining a first fluid passage connecting said condenser to said housing and a second fluid passage connecting said housing to said evaporator, said second of said two valves being positioned in said first fluid passage, and said expansion valve being positioned in said second fluid passage.

19. Apparatus according to claim 18, further comprising means for providing a continuous flow of fluid from said housing to said first gas conduit, whereby noise in said first gas conduit is avoided.

20. Apparatus according to claim 19, wherein said means for providing a continuous flow includes a fluid conduit connecting said peripheral region of said housing and said first gas conduit, whereby pressure on said liquid annulus forces fluid from said liquid annulus through said fluid conduit to said first gas conduit.

21. Apparatus according to claim 20, wherein a nozzle is positioned in said fluid conduit.

22. Apparatus according to claim 18, wherein said means for providing a continuous flow includes means for providing a constant leak of liquid in said first fluid passage through said second valve, whereby said liquid annulus in said housing is continuously renewed so that said liquid annulus is vaporized to feed said first gas conduit.

23. Apparatus according to claim 1, wherein the compressor is a screw compressor having slides for adjusting the working conditions of said compressor.

* * * * *

UNITED STATES PATENT AND TRADEMARK OFFICE

CERTIFICATE OF CORRECTION

PATENT NO. : 4,509,341

DATED : April 9, 1985

INVENTOR(S) : Bernard Zimmern

It is certified that error appears in the above-identified patent and that said Letters Patent is hereby corrected as shown below:

The drawings should be amended to include the attached Figs. 7-10.

Signed and Sealed this

Twenty-first Day of April, 1987

*Attest:*

*Attesting Officer*

DONALD J. QUIGG

*Commissioner of Patents and Trademarks*